United States Patent [19]

Colavecchio

[11] 4,317,098

[45] Feb. 23, 1982

[54] GROUNDED THERMOSTAT SWITCH

[75] Inventor: Robert Colavecchio, Johnston, R.I.

[73] Assignee: Elmwood Sensors, Inc., Cranston, R.I.

[21] Appl. No.: 117,535

[22] Filed: Jan. 28, 1980

[51] Int. Cl.[3] ..... H01H 37/74

[52] U.S. Cl. ..... 337/113; 337/343

[58] Field of Search ..... 337/113, 365, 89, 343

[56] References Cited

U.S. PATENT DOCUMENTS

| | | | |
|---|---|---|---|
| 3,577,111 | 5/1971 | Nardulli | 337/113 |
| 3,972,016 | 7/1976 | Schmitt | 337/365 X |
| 4,059,817 | 11/1977 | Hollweck et al. | 337/365 |
| 4,091,354 | 5/1978 | Deubel et al. | 337/365 |

*Primary Examiner*—George Harris

*Attorney, Agent, or Firm*—Salter & Michaelson

[57] ABSTRACT

A grounded thermostat comprising a housing of non-conductive material, a cap of conductive material constituting a fixed grounded contact, a live movable contact supported in the housing in spring-biased engagement with the fixed grounded contact, a non-conductive transfer pin mounted with an end in the housing in engagement with the movable contact and with its other end protruding through the cap, and a bimetallic element secured to the cap in a position to engage the protruding end of the transfer pin responsive to predetermined thermal conditions.

12 Claims, 4 Drawing Figures

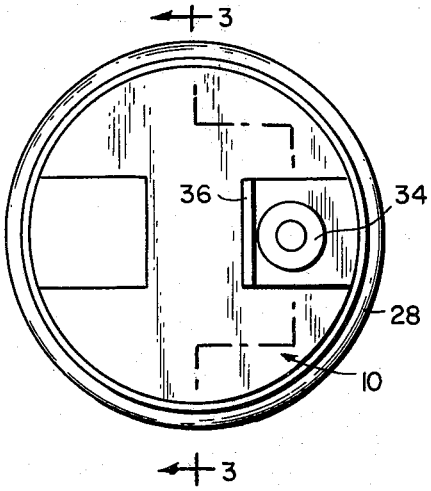
FIG. 1
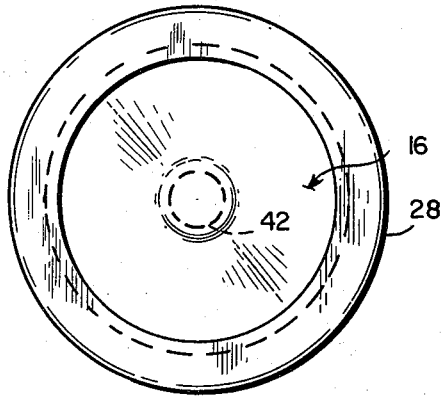
FIG. 2
FIG. 3
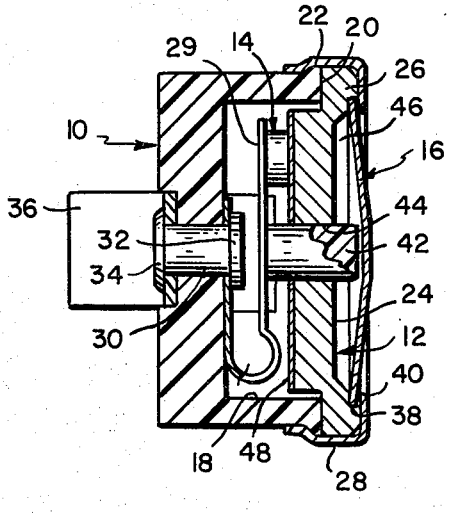
FIG. 4
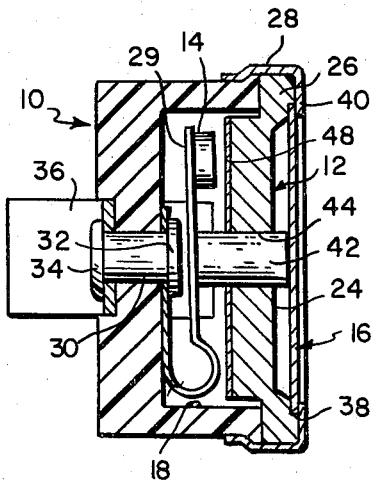

GROUNDED THERMOSTAT SWITCH

BACKGROUND OF THE INVENTION

It is known in the prior art to manufacture thermostatic switches comprising a housing of electrically nonconductive material having a cap of nonconductive material attached thereto so as to provide a closed chamber, a fixed contact member within the chamber, and a movable contact also within the chamber normally in engagement with the fixed contact to close the switch, and a transfer pin projecting through the cap into the chamber for engagement with the movable contact to force the latter away from the fixed contact to open the switch. Movement of the transfer pin is controlled by a bimetallic disc mounted to the cap exteriorly of the chamber so as to engage the protruding end of the transfer pin to move the latter axially to disengage the movable contact from the fixed contact responsive to a predetermined temperature condition. The switch as thus constructed makes or breaks the flow of current between two live conductors, one of which is electrically connected to the fixed end of the movable contact and the other of which is connected to a terminal which is in turn connected to the fixed contact.

There are, however, situations wherein only one live conductor is used to pass current to the switch, that is, the switch is connected to ground rather than having a second live conductor which carries away the current. If such is the situation, it would be necessary to electrically shunt the terminal which extends from the fixed contact to the metallic peripheral cap that is normally used to maintain the housing, cover, and disc in assembled relation, it being understood that the cap is connected to ground by virtue of the mounting of the switch assembly in a member or device that is in turn grounded. It is obviously impractical to connect such a shunt between the fixed contact and the cap member and so thermostatic switches have been specifically designed for grounded application. For example, the bimetallic disc may be provided with a contact member centrally secured to its upper surface whereby when the disc snaps upwardly to its closed position, the contact engages a fixed contact to close the switch. Since the peripheral edge of the bimetallic disc is retained by and hence is in engagement with the metallic cap, the switch will automatically be grounded because, when the switch is closed, current will flow through the disc to the cap to effect grounding.

The problem with this type of arrangement is that the flow of current through the bimetallic disc generates heat which adversely affects the thermostatic action of the switch. For example, the heat so generated causes the switch to prematurely close or open, as the case may be. The purpose of the present invention is to design a grounded thermostatic switch of improved design so as to make possible continued use of standard parts of a conventional thermostatic switch as much as possible and so as to eliminate the flow of current through the bimetallic element, thus eliminating adverse effects in the thermal accuracy of the switch, as would happen in the grounded switch referred to above.

SUMMARY OF THE INVENTION

The present invention relates to a thermostatic switch comprising a housing having an open end, said housing being comprised of an electrically nonconductive material, a cover of conductive material covering the open end of the housing, means for securing the cover to the open end of the housing so that the housing and cover in conjunction define a closed chamber, a movable contact mounted within the chamber normally biased into engagement with said cover but movable away therefrom, said movable contact having a fixed end electrically connected to the live side of a circuit. The cover constitutes a fixed contact and is adapted to be grounded by virtue of its engagement with the metallic retaining cap which maintains the cover and bimetallic disc assembled to the housing. A nonconductive transfer pin extends slidable through the cover with its end in the chamber in engagement with the movable contact and with its other end projecting outwardly of the cover and adapted to be engaged by a circular bimetallic disc supported exteriorly of the chamber at the outer side of the cover, whereby operation of the disc responsive to a given temperature condition causes inward axial movement of the pin to separate the movable contact from the cover or fixed contact and hence open the switch. The cover contains a centrally positioned bore within which the transfer pin is reciprocably positioned, a peripheral groove on the outer surface thereof for receiving the peripheral edge of the bimetallic disc, and a recess to permit movement of the bimetallic element. The cover comprising the fixed contact has a center circular portion which is of smaller cross section than the chamber so that it fits into the chamber and a peripheral flange corresponding in cross sections to the outer cross dimension of the housing so that it seats substantially flush against the open end of the housing. As aforesaid, means for securing the cover to the housing comprises a metallic retaining cap, said cap also functioning to assemble the bimetallic disc to the outer surface of said cover. The inner surface of the central portion of the cover or fixed contact is provided with a thin coating of silver or other highly electrically conductive material.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention:

FIG. 1 is a plan view of one side of the grounded thermostatic switch according to this invention;

FIG. 2 is a plan view of the other side of the grounded thermostat according to this invention;

FIG. 3 is a diametral section taken on the line 3—3 of FIG. 1 with the movable contact spring-biased into engagement with the fixed contact; and FIG. 4 is a section corresponding to FIG. 3 with the movable contact disengaged from the fixed contact.

DESCRIPTION OF THE INVENTION

Referring to the drawing, the grounded thermostatic switch comprises a housing 10, a cover 12 which, as will appear hereinafter, functions as a fixed contact, a movable contact 14 and a bimetallic element 16. The housing is comprised of a nonconductive material, is preferably of circular cross section and defines an open-ended chamber 18 at the open end of which there is a rim 20 provided with an outwardly-protruding lip 22. The cover 12 is comprised of conductive material such as brass and is in the form of a disc 24 dimensioned to enclose the chamber 18 and provided with an annular flange 26 dimensioned to seat against the rim 20 of the housing 10 and to be attached thereto by a metallic retaining cap 28. It is important to note that both the cover and the cap are comprised of conductive metal and that the cover actually functions as the fixed contact of the switch.

The movable contact 14 is fixed to the end of a spring arm 29, the other end of which is mounted to the housing by means of a terminal pin or rivet 30 which has at its inner end a head 32 engaged with the spring member and at its other end a head 34 engaged with a lead member or terminal 36. The spring member resiliently biases the movable contact 14 into engagement with the inner surface of the fixed contact 24.

The bimetallic element 16 is in the form of a circular disc and is mounted externally of the cover 12 with an annular recess 38 formed in its outer side, by means of flange portion 40 of the retaining cap 28. Movement of the bimetallic element in response to a temperature change is transmitted to the spring arm of the movable contact to move the latter away from the fixed contact by a transmitter element or transfer pin 42 mounted in bore 44 extending through the cover, with one end extending into the chamber in engagement with the spring arm and the other end protruding from the cover into a position closely adjacent to the inner side of the bimetallic element. Desirably, the outer face of the cover is recessed at 46 to allow the bimetallic element some freedom of play. The pin 42 is of nonconductive material.

As thus constructed, the thermostatic switch has only one live contact, that is, the movable contact 14 which is connected by the spring arm 29 to the terminal 30 and lead 36.

When the switch is closed, i.e. the movable contact 14 is in engagement with fixed contact 24, connection to ground is accomplished by the flow of current through the cover 12 to annular flange 26 and then to retaining cap 28 which is grounded by virtue of the mounting of the switch in a member or device that is in turn somehow grounded. The result is a highly simple, low resistance connection to ground because the path of current flow from contact 24 to cap 28 is minimal, and since no appreciable current flows through this bimetallic disc 16, no heat is generated therein such as would adversely affect the thermal accuracy of the switch.

Preferably, the inner surface of the fixed contact is coated with a thin layer 48 of silver or other suitable metal of high electric conductivity so as to effect a better contact.

It will be understood that the grounded thermostatic switch of the present invention has particular utility in connection with various hand held electric appliances where it is desired to automatically shut off current to the device when the temperature of the device reaches a predetermined limit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A thermostatic switch comprising means defining a receptacle, one side of which is electrically nonconductive and the other side of which is electrically conductive, said electrically conductive side constituting a fixed contact, a movable contact supported within the receptacle from the nonconductive side thereof, and spring-biased into engagement with the fixed contact, an electrically nonconductive transmitter element extending through the electrically conductive side having an end in the receptacle in engagement with the movable contact and an end protruding from the receptacle, and a bimetallic element affixed to the receptacle in operative relation to the protruding end of the nonconductive transmitter.

2. A thermostatic switch comprising a nonconductive receptacle and a conductive closure therefor, said receptacle and closure defining a closed chamber, one side of which is nonconductive and the other side of which is conductive, said conductive side constituting a fixed contact, a movable contact, means mounting the movable contact in the chamber from the side of the nonconductive receptacle opposite the fixed contact and resiliently urging said movable contact into engagement with the fixed contact, a nonconductive transmitter member extending through the closure with an end in the chamber in engagement with the movable contact and an end protruding from the chamber for reciprocal movement, and a bimetallic element affixed to the closure exteriorly of the chamber in a position to have engagement with the protruding end of the transmitter operable to at times move the transmitter member in a direction to disengage the movable contact from the fixed contact.

3. A thermostatic switch comprising a receptacle defining a chamber, said receptacle being comprised in part of nonconductive material and in part of a conductive material, said latter part constituting a fixed contact member, a movable contact member of conductive material situated in the chamber adjacent the fixed contact member, said movable contact member being spring-biased into engagement with the fixed contact, a bimetallic element attached to the receptacle exteriorly of the chamber and a nonconductive transmitter extending from the bimetallic element through the fixed contact into engagement with the movable contact, said transmitter being movable by the bimetallic element to separate the movable contact from the fixed contact.

4. A thermostatic switch comprising a receptacle having spaced walls defining a chamber therebetween, one of which is nonconductive and constitutes a support and the other of which is conductive and constitutes a fixed contact, a movable contact yieldably supported from the nonconductive support and normally in engagement with the fixed contact, a nonconductive transmitter supported with an end in the chamber in engagement with the yieldably-supported movable contact and its other end projecting from the receptacle, and a bimetallic element mounted to the receptacle in a position adjacent the projecting end of the transmitter for at times by engagement with the projecting end of the transmitter to move the latter in a direction to disengage the movable contact from the fixed contact.

5. A switch according to claim 1 wherein a hairpin spring supports the movable contact in spring-biased engagement with the fixed contact.

6. A switch according to claim 1 wherein the surface of the fixed contact which is in engagement with the movable contact has a coating thereon of metallic material that has higher electrical conductivity than the material of which said fixed contact is constructed.

7. A thermostatic switch comprising means defining a circular housing having an open end, said housing being comprised of a nonconductive material, a cover of conductive material covering the open end of the housing, means for securing the cover to the open end of the housing so that the housing and cover in conjunction define a closed chamber, a movable contact mounted in the chamber in spring-biased engagement with the cover, said cover constituting a fixed contact, means for connecting the movable contact with the live side of a circuit, said securing means being comprised of conductive material and maintaining said cover assembled to said housing, whereby when said securing means is connected to ground said fixed contact will automatically be grounded by virtue of its engagement with said securing means, a nonconductive transmitter slidably supported in said cover with an end within the chamber in engagement with the movable contact and with its other end projecting from the housing, and a bimetallic element supported exteriorly of the chamber at the outer side of the cover in a position to engage the projecting end of the transmitter.

8. A switch according to claim 7 wherein the outer face of the cover is recessed to provide space for movement of the bimetallic element.

9. A switch according to claim 7 wherein the outer side of the cover has at its periphery a recessed groove for receiving the peripheral edge of the bimetallic element, and the securing means for securing the cover to the housing comprises a ring, a part of which overlies the housing and a part of which overlies the peripheral edge of the bimetallic element to maintain the latter in assembled relation.

10. A switch according to claim 9 wherein the cover comprises a circular center portion of smaller cross section than the open end of the housing so that it fits into the housing, and a peripheral flange generally corresponding in diameter to the outer diameter of the housing, said flange being held in engagement with the open end of the chamber by said ring.

11. A switch according to claim 10 wherein the surface of said circular center portion has a coating thereon of metallic material that has higher electrical conductivity than the material of which said fixed contact is constructed.

12. A switch according to claim 11 wherein said coating is silver and said fixed contact is brass.

* * * * *